US006577242B2

(12) United States Patent
Jen et al.

(10) Patent No.: US 6,577,242 B2
(45) Date of Patent: Jun. 10, 2003

(54) WIRELESS TRANSFER OF DATA FROM A DETECTOR

(75) Inventors: Hsing C. Jen, Barrington, IL (US); James S. Slater, Maple Park, IL (US)

(73) Assignee: Pittway Corporation, St. Charles, IL (US)

( * ) Notice: Subject to any disclaimer, the term of this patent is extended or adjusted under 35 U.S.C. 154(b) by 0 days.

(21) Appl. No.: 09/849,797

(22) Filed: May 4, 2001

(65) Prior Publication Data

US 2002/0186141 A1 Dec. 12, 2002

(51) Int. Cl.[7] ..... G08B 23/00

(52) U.S. Cl. ..... 340/693.5; 340/693.6; 340/628; 340/630; 340/577; 340/825.72

(58) Field of Search ..... 340/693.5, 693.6, 340/628, 630, 577, 825.72

(56) References Cited

U.S. PATENT DOCUMENTS

| | | | | |
|---|---|---|---|---|
| 4,402,090 A | | 8/1983 | Gfeller et al. | |
| 4,426,662 A | | 1/1984 | Skerlos et al. | |
| 4,628,541 A | | 12/1986 | Beavers | |
| 4,688,021 A | | 8/1987 | Buck et al. | |
| 4,704,607 A | | 11/1987 | Teather et al. | |
| 4,709,411 A | | 11/1987 | Mori et al. | |
| 4,727,600 A | | 2/1988 | Avakian | |
| 4,827,244 A | | 5/1989 | Bellavia et al. | |
| 4,977,618 A | | 12/1990 | Allen | |
| 5,051,601 A | | 9/1991 | Atobe et al. | |
| 5,191,461 A | | 3/1993 | Cranshaw et al. | |
| 5,471,194 A | | 11/1995 | Guscott | |
| 5,475,364 A | | 12/1995 | Kenet | |
| 5,557,262 A | * | 9/1996 | Tice | 340/587 |
| 5,566,022 A | | 10/1996 | Segev | |
| 5,621,384 A | | 4/1997 | Crimmins et al. | |
| 5,691,699 A | | 11/1997 | Vane et al. | |
| 5,751,216 A | * | 5/1998 | Narumiya | 340/630 |
| 5,751,218 A | * | 5/1998 | Winterble et al. | 340/693 |
| 5,808,541 A | * | 9/1998 | Golden | 340/628 |
| 5,999,552 A | | 12/1999 | Bogner et al. | |
| 6,182,497 B1 | * | 2/2001 | Krajci | 340/632 |

* cited by examiner

*Primary Examiner*—Daniel J. Wu
*Assistant Examiner*—Hung Nguyen
(74) *Attorney, Agent, or Firm*—Welsh & Katz, Ltd.

(57) ABSTRACT

An ambient condition detector incorporates a common radiant energy source to carry out a first, sensing, function and a second, information transmitting function. The source can generate a beam to implement a fire sensing function. In addition, modulated radiant energy emitted from the source can be remotely sensed to determine detector status or internal parameter values. In an alternate embodiment, a source of radiant energy can be configured at an exterior periphery of the detector and information can be wirelessly transmitted therefrom using one or more analog modulation processes.

28 Claims, 7 Drawing Sheets

10
12 - 1
12
CONTROL
24
24i - 1
24i
14
16
16i
16j
16i
16k
20
u 16i
14
SMOKE CHAMBER
24i - 1
16i - 2
16i - 5
I/O
16i - 4
18i - 1
16i - 3
18i - 2
16i - 1
PLASTIC HOUSING
18i - 3
20

START
110
112
WAIT FOR PULSE
NO
YES
114
SET TIMER TO 0
START TIMER
116
WAIT FOR PULSE
NO
YES
118
TIME < 247uS
YES
NO
120
TIME < 422uS
NO
YES
122
SAVE t1 = TIMER
SET TIMER TO 0
START TIMER
124
WAIT FOR PULSE
NO
YES
126
TIME < 40uS
YES
NO
128
TIME < 70uS
NO
YES
130
SAVE t2 = TIMER
SET TIMER TO 0
START TIMER
132
WAIT FOR PULSE
YES
NO
134
TIME < 100uS
YES
NO
136
UPDATE DISPLAY BASED ON t1 AND t2 VALUES

WIRELESS TRANSFER OF DATA FROM A DETECTOR

FIELD OF THE INVENTION

The invention pertains to multi-unit monitoring systems. More particularly, the invention pertains to such units which are capable of wirelessly transmitting status information or parameter values to displaced observers.

BACKGROUND OF THE INVENTION

Monitoring systems having a large number of interconnected detectors are known to be useful in monitoring various conditions in a region. Various maintenance and test procedures have been developed to facilitate servicing such systems. One testing vehicle has been disclosed in Bellavia et al. U.S. Pat. No. 4,827,244.

Bellavia et al. teach the wireless initiation of a test function. The transmission of information from a detector in both human perceptible and machine readable form is also known.

It would be desirable to facilitate the wireless transfer of information to service personnel in the area of the respective detector. It would also be desirable to be able to implement such transmissions using, if possible, components already present on or in the respective detectors.

SUMMARY OF THE INVENTION

An ambient condition detector incorporates a source of radiant energy, for example, an infrared emitting diode, to carry out a sensing function. The source is located within the detector and is not visible from locations outside of the detector.

A control circuit within the detector drives the source with a modulated electrical signal. In a disclosed embodiment, one portion of the signal is associated with a sensing function. Another portion is associated with an external information transfer function. In other embodiments, the sensing related portion could also be modulated with the information to be transferred.

The detector includes an opaque, radiant energy transmissive housing which contains the source. Radiant energy which is emitted from the source passes, in part, through the housing and is radiated from the housing into the surrounding ambient atmosphere. The radiated signal can be sensed and demodulated to extract the transmitted information.

A variety of transmission protocols can be used. Parameter values or status indicators can be transmitted from the detector using analog modulation. Pulse amplitude, pulse position, pulse width or frequency modulation can be used. Other analog modulation processes could be used including phase modulation. Alternately, a binary representation can be transmitted.

In another embodiment, information could be transmitted, using one or more analog protocols, from a light emitting diode. This diode could be located at an exterior peripheral surface of the detector.

In this embodiment, parameter values and status information can be wirelessly transmitted using the modulated waveform. Periods of transmitted signals can be in a range on the order of 3–10 seconds.

In yet another aspect, a portable unit can receive and demodulate the modulated signals. Parameter values or status indicators can be displayed at the unit.

Numerous other advantages and features of the present invention will become readily apparent from the following detailed description of the invention and the embodiments thereof, from the claims and from the accompanying drawings.

DETAILED DESCRIPTION OF THE PREFERRED EMBODIMENTS

Figure 1:
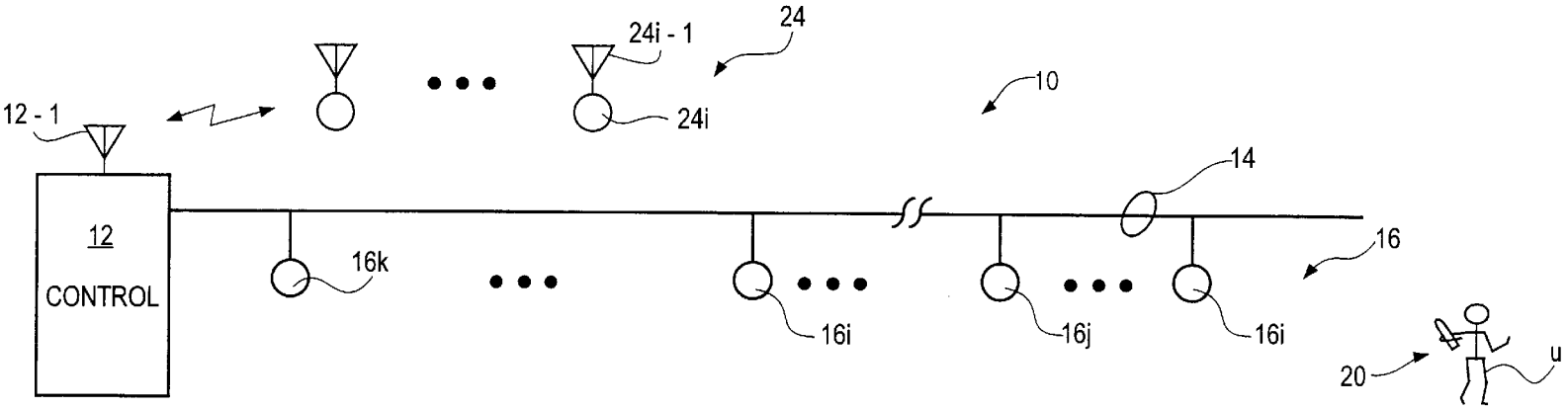
FIG. 1 is a diagram of a system in accordance with the present invention.

While this invention is susceptible of embodiment in many different forms, there are shown in the drawing and will be described herein in detail specific embodiments thereof with the understanding that the present disclosure is to be considered as an exemplification of the principles of the invention and is not intended to limit the invention to the specific embodiments illustrated.

FIG. 1 illustrates a system 10 in accordance with the present invention. The system 10 incorporates a common element 12, which could be implemented with one or more programmed processors. The element 12 is coupled to a bi-directional wired medium such as electrical cable or optical fiber 14. A plurality of devices 16 is coupled to the medium 14 and in bidirectional communication with the control element 12. The devices 16 can include one or more detectors, such as detector **16*i*, as well as audible or visible output devices 16*j* and/or various types of control devices 16*k***, all of which would be known to those of skill in the art.

The members of the plurality 16 can transmit, wirelessly, status information to a hand-held unit 20 carried by an operator or maintenance person U. The unit 20 enables the maintenance person U to walk through regions monitored by the system 10 and to wirelessly download from the respective units, such as units **16*i*, 16*j* or 16*k* status information, parameter values and the like without having to physically contact the respective device or disconnect it from the medium 14**.

Alternately, or in addition to, the system 10 can include a plurality of wirelessly coupled electrical units 24. These units, as illustrated by the representative electrical unit **24*i* carry wireless transmitters and, in the case of using RF communication respective RF antennae 24*i*-1. In this embodiment, control element 12 also carries a wireless antenna of an appropriate type 12-1 so as to carry on wireless communication with the unit 24***i*. The portable reader 20 can be used to download status and parameter information from the members of the plurality 24 just as for the members of the plurality 16.

Figure 2:
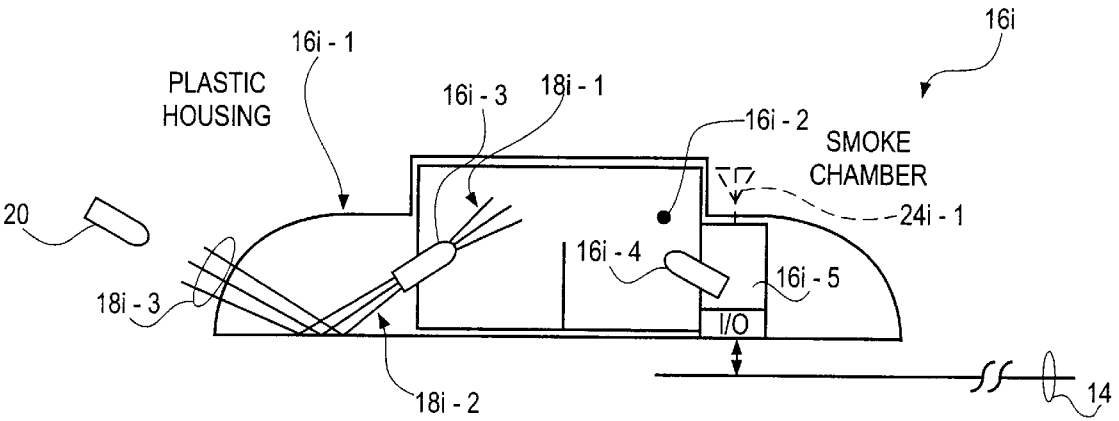
FIG. 2 is a side sectional view of a detector in accordance with the present invention.

FIG. 2 illustrates an exemplary detector 16*i* which includes a housing 16*i*-1. Housing 16*i*-1 carries a photoelectric smoke chamber 16*i*-2.

The chamber 16*i*-2 includes a radiant energy emitter 16*i*-3 which could be implemented using a laser diode or light emitting diode. The radiant energy can be emitted at a variety of frequencies all without limitation of the present invention except as noted below.

Radiant energy 18*i*-1 is projected into the smoke chamber 16*i*-2 by the emitter 16*i*-3. A portion of that radiant energy is scattered by smoke in the chamber, as understood by those of skill in the art, and is detected by photosensor 16*i*-4. The emitter 16*i*-3 and the sensor 16*i*-4 are coupled to control circuitry 16*i*-5 of a type which would be known to those of skill in the art.

The circuitry 16*i*-5, in addition to energizing the emitter 16*i*-3 and reading the signal back from the sensor 16*i*-4, can include bidirectional interface circuitry for communicating with the medium 14 or an antenna corresponding to the antenna 24*i*-1 for wireless communication with the control element 12. The control element 16*i*-5 can be implemented, at least in part, with a programmed processor.

When the control element 16*i*-5 energizes the emitter 16*i*-3 in addition to emitting the desired radiant energy 18*i*-1, the emitter leaks radiant energy 18*i*-2. A portion of the leakage radiation 18*i*-3 passes through the plastic housing 16*i*-1 and can be sensed at hand-held unit 20.

In one embodiment, a wall portion of the housing 16*i*-1 can be formed with a reduced thickness on the order of 0.35 through 0.045 inches to facilitate transmissivity of the leakage radiation 18*i*-2 through the housing. Plastic such as polycarbonate (available commercially as FR110) is transmissive of leakage radiation 18*i*-2, in a wavelength range of 820 nm to 950 nm (nano-meters) so as to be detected by hand-held unit 20. Polypropylene can also be used.

With appropriate drive signals, as would be understood by those with skill in the art, a broader range, including 500 to 950 nm, can be expected to emit sufficient stray radiation for detection by an appropriate handheld unit.

Figure 3:
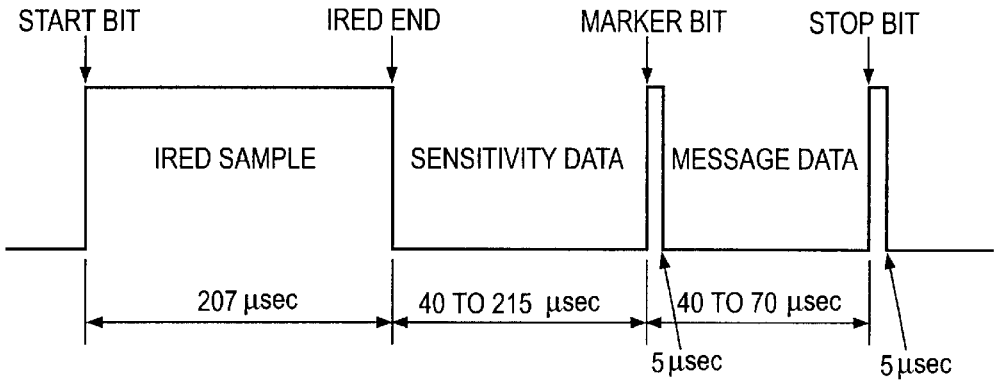
FIG. 3 is a timing diagram which illustrates aspects of the operation of the detector of FIG. 2.

FIG. 3 illustrates a timing diagram of a representative modulated signal used to drive emitter 16*i*-3, which in turn produces leakage radiation 18*i*-3 for detection by unit 20. The source of 16*i*-3, which might be an infrared emitting laser diode or infrared light emitting diode is driven by control circuitry 16*i*-5 for on the order of 207 microseconds to produce a stabilized sample interval for the sensor 16*i*-4 to detect smoke scattered radiant energy. Two subsequent pulse position modulated indicators, identified in FIG. 3 as "marker bit" and "stop bit" can be used to transmit detector parameter values, such as sensitivity data status or advisory messages such as in an analog format and message data in an analog format. Exemplary messages include status or advisory messages such as "replace", "good", and variations of "dirty" or "service".

Figure 4A:
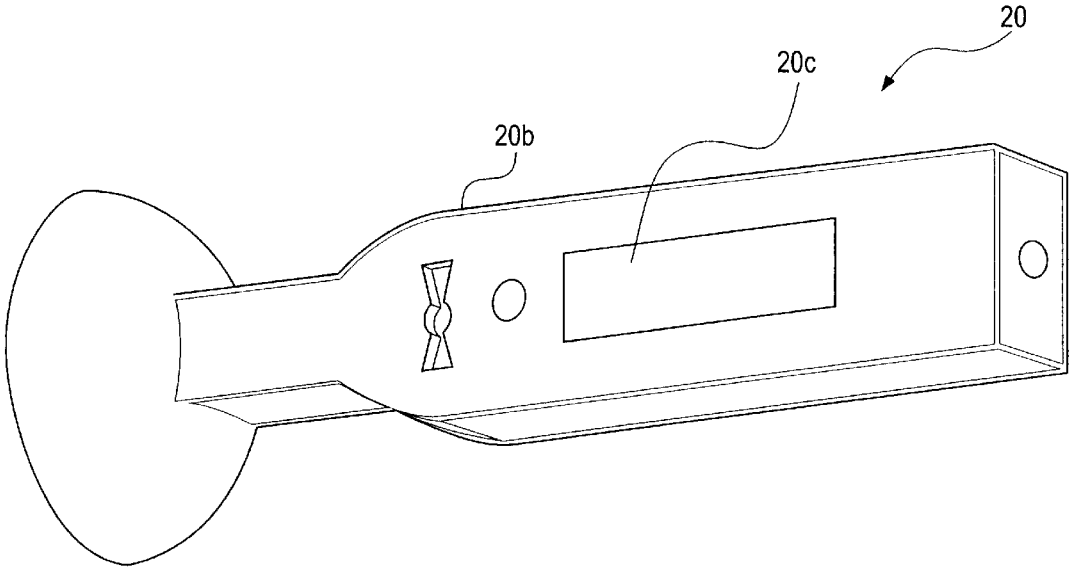
FIGS. 4A–4B are diagrams of a hand held, portable reader usable with the detector of FIG. 2.
Figure 4B:
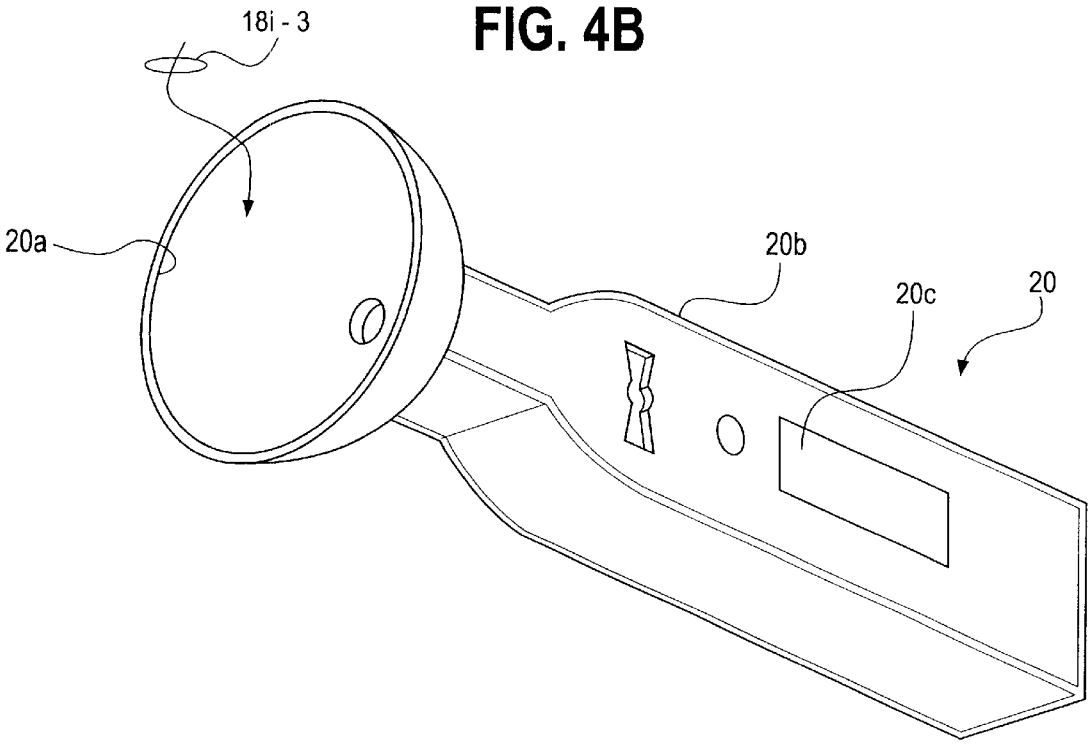

FIGS. 4A and 4B are illustrations of an exemplary hand-held sensing unit 20. The unit 20, depending on the form of wireless transmission, can include an antenna (RF) or optical collector or focusing surface 20*a* (infra-red) which is carried by a housing 20*b*. The housing 20*b* also carries a visual display, which could be implemented as a liquid crystal display 20*c*. Those of skill will understand that the antenna or collecting surface 20*a* would be configured so as to be consistent with the form of radiant energy to be sensed. A plurality of user controls, discussed subsequently, is carried by housing 20*b*.

Figure 5:
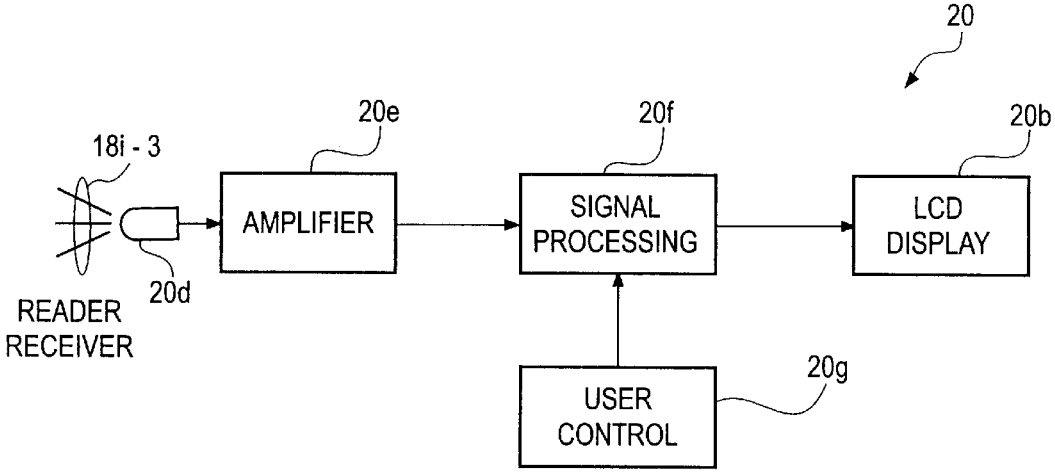
FIG. 5 is a block diagram of components of the reader of FIG. 4.

FIG. 5 illustrates additional details of the hand-held unit 20 usable to detect infrared. Incident, modulated infrared is detected at a radiant energy sensor, such as a photodiode or phototransistor 20*d* whose output is in turn coupled to an amplifier 20*e*. An amplified output is processed in signal processing and control circuitry 20*f*. The signal processing circuitry 20*f*, in response to detecting the presence of protocol, previously discussed in FIG. 3, in the leakage radiation 18*i*-3 can in turn demodulate same to determine a numeric value of a parameter, such as sensitivity, and status information, such as a range such that the numeric value and range can be, for example, alternately displayed on display 20*b*.

User control element 20*g* can include pushbuttons for turning the unit 20 on and off as well as for selecting the type of information to be displayed as would be understood by those of skill in the art. The reader or unit 20 can be powered by a replaceable battery and can include a status indicating audible output device.

Figure 6:
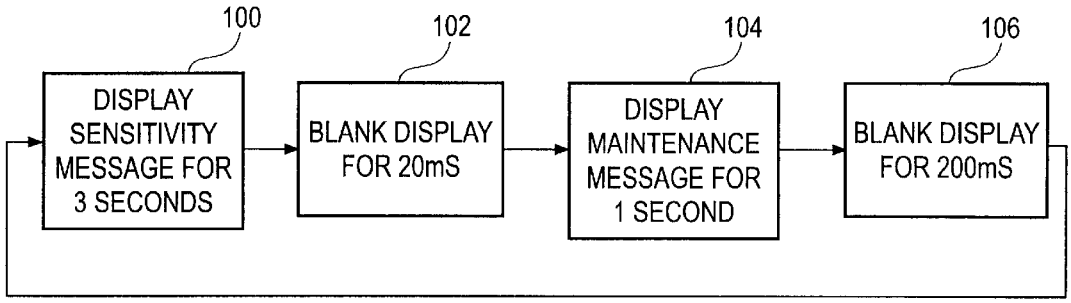
FIG. 6 is a timing block diagram which illustrates aspects of the operation of the reader of FIG. 4A.

As illustrated in FIG. 6, the processing circuitry 20*f* could in a step 100 display sensitivity in a numeric form for a period of time such as three seconds. In a step 102, the display can be darkened for a predetermined interval.

In a step 104, a maintenance indicating status message can be displayed for a predetermined period of time followed by another darkened interval, step 106, whereupon the display process repeats itself. It will be understood that the process illustrated in FIG. 6 is exemplary only and variations therefrom do not depart from the spirit and scope of the present invention.

It will also be understood, that the unit 20 could incorporate if desired an audible output device which would indicate to the user that valid data had been read and is available for presenting either numerically or in the form of a status message. Other messages can be presented on display 20 to display the reader unit's own status. These include ready and a low-battery message. It will also be understood that the received parameter data or associated maintenance message could be continuously displayed subject to user control using one or more of the user control elements 20*g*.

The following data representations, messages and related reader functionality information are exemplary only and are not limitations of the present invention:

| | |
|---|---|
| Parameter Value Or Values Such As Sensitivity X.X %/FT | Sensitivity data can be continuous displayed in % per foot (2 digits and decimal point). Valid range can be 0.0 to 9.9. |
| Status messages SERVICE | Maintenance condition has been reached. The device under test should be cleaned. Display is continuous. |
| DIRTY | Pre-high maintenance condition has been reached. The device under test should be cleaned soon. Display is continuous. |
| GOOD | The device under test is within its sensitivity limit. Display is continuous. |
| REPLACE | Low maintenance condition has been reached. The device under test needs to be replaced right away. The display is continuous. |

While the reader is on, any time the battery voltage falls too low, the display will change to read LOW BATT. The display is continuous. Once in this mode, the reader 20 stays in this mode until a time period, 30 minutes, has expired or the reader 20 is turned off. No data can be transferred to the reader in this mode.

While the reader 20 is on, and not in low battery mode, anytime a pushbutton is momentarily pressed and released within 2 seconds, the display will change to a continuous READY to indicate it is ready for another data transfer.

Any time the reader 20 is on, 30 minutes of inactivity (no button pushes), the reader will automatically turn off.

Any time the reader 20 is on, if the pushbutton is pressed and held for 2 seconds, the horn will beep, for example for 600 mS, and the reader will turn off.

Whenever the display changes from one message to the next message, there a 200 mS period of no display separates the messages.

Figure 7A:
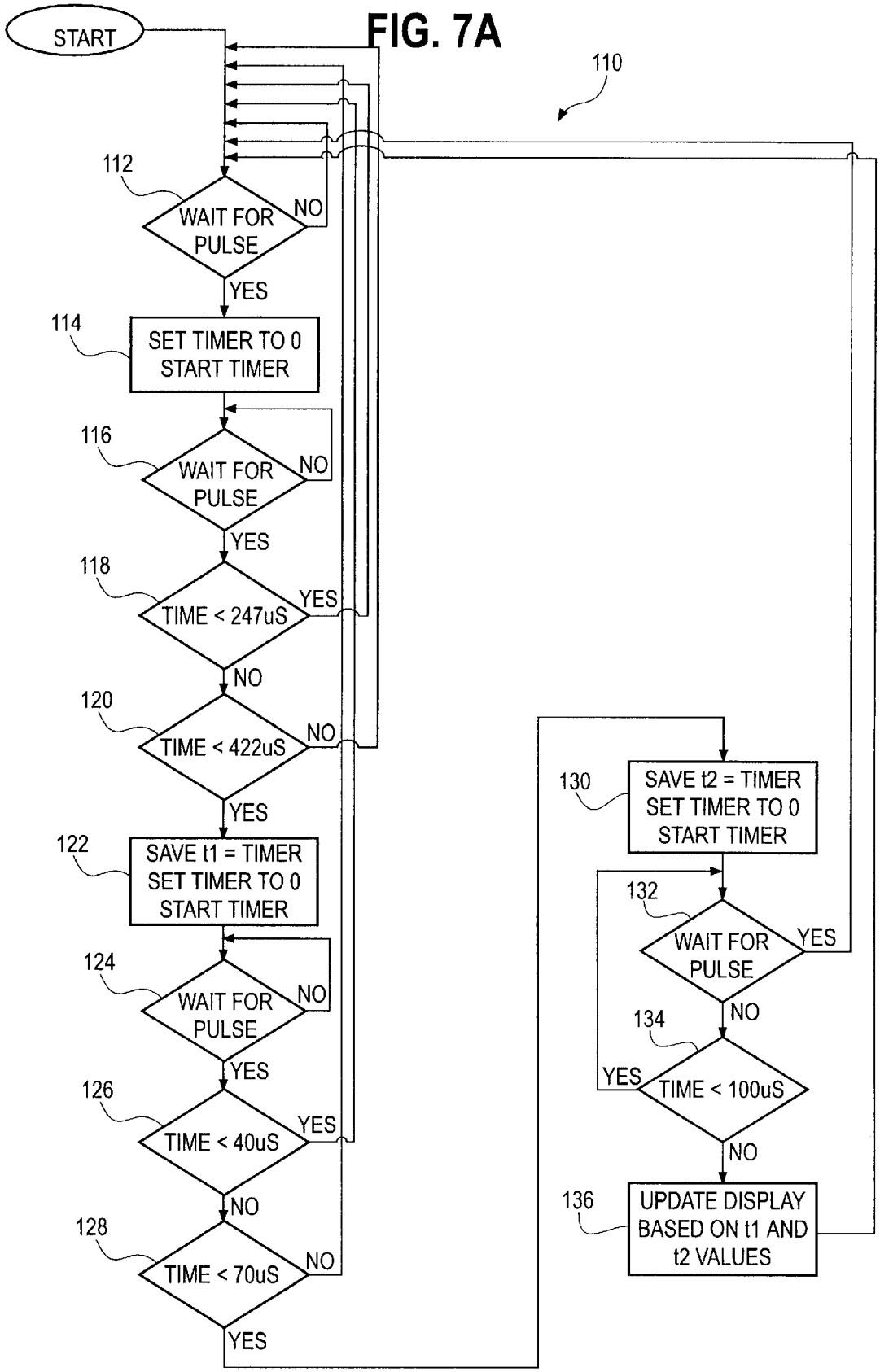
FIG. 7A is a flow diagram illustrating processing carried out by the reader of FIG. 4A.

FIG. 7A is a flow diagram illustrating exemplary data acquisition and processing by processing circuitry 20*f* utilizing the communication protocol previously discussed in FIG. 3. In a step 112, the circuitry awaits receipt of an initial pulse, corresponding for example to the 207 $\mu$S sample pulse of FIG. 3. Upon receipt thereof, in a step 114, circuitry 20*f* zeros out a timer and enables that timer.

In a step 116, the circuitry waits for the beginning of the next pulse, which, with respect to the protocol of FIG. 3, corresponds to the marker bit. If the time in the timer is less than 247 $\mu$S, step 118, the marker bit will not yet have arrived. If the time in the timer exceeds 247 $\mu$S, but is less than 422 $\mu$S, step 120, a valid marker bit pulse has probably been received. In this event, the current value of the timer is saved, step 122, the timer is zeroed and again enabled.

The next pulse is awaited, step 124. If the lapsed time in the timer is less than 40 $\mu$S, step 126, the expected stop bit will have not as yet arrived. If the pulse has arrived and the time is less than 70 $\mu$S, step 128, a valid stop bit has been detected. The second value is saved as T2, step 130, and the timer is zeroed and re-enabled.

The next pulse is awaited, step 132. If a pulse arrives within 100 $\mu$S, the process returns to step 112 and repeats. Alternately, if 100 $\mu$S passes and no additional pulses are received, step 134, the processing circuitry 20*f* can up-date the display 20*b* based on the contents of the T1 and T2 registers, step 136.

It will be understood that the above processing methodology of FIG. 7A can be varied to take into account the amount and types of data transmitted, the number and nature of the pulses as well as other analog transmission protocols without departing from the spirit and scope of the present invention.

Figure 7B:
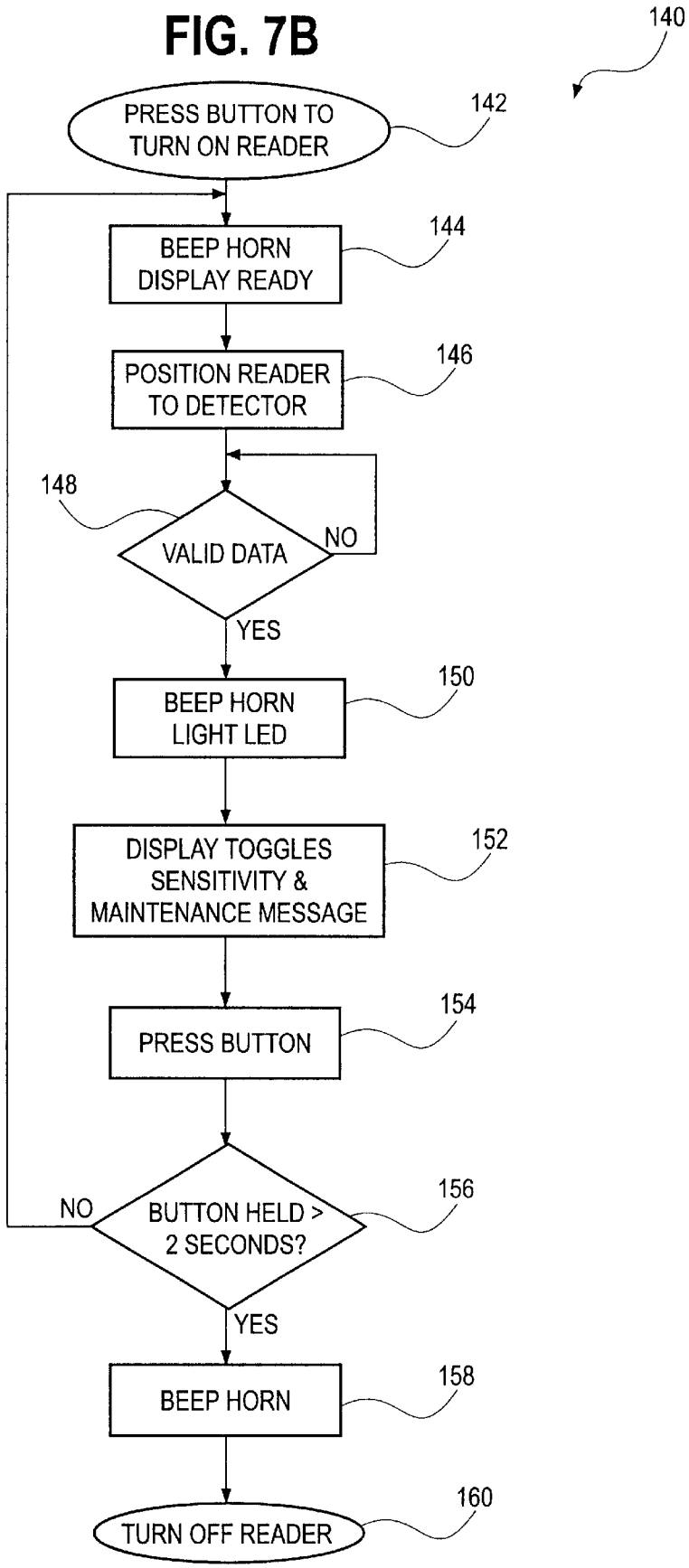
FIG. 7B is a flow diagram illustrating a method of using the reader of FIG. 4A.

FIG. 7B illustrates the steps of a method 140 of using the reader 20. In an initial step 142, the reader is activated by turning it on. Where the reader 20 incorporates an audible output device, the device can be activated to produce an audible alarm and the display 20*b* can be activated to display a "ready" visual indicator, step 144.

In a step 146, the user U positions the reader so as to pick up the relevant radiation from the unit whose parameters or status are being read, such as exemplary unit 16*i*. If the processing circuitry 20*f* determines that valid data from the respective electrical unit has been detected and processed, step 148, both audible and visible indications will be presented by the unit 20, step 150.

In a step 152, the display 20*b* can be driven in a toggle mode so as to alternately display, for example, a parameter value such as sensitivity value and a status message. It will be understood that the type of parameter value being displayed is dependent upon the type of electrical unit whose transmission is being sensed. Other types of parameters and messages can be received, demodulated and displayed by the unit 20 without departing from the spirit and scope of the present invention.

The reader 20 can be turned off by pressing an on/off button, step 154 for a two second interval, step 156. In such event, the audible device can provide an audible turn off tone step 158 prior to the reader turning off step 160. Alternately, it will be understood that if the on/off button is held for less than two second, step 156, alternate functions can be indicated such as freezing the current representation of the display 20*b* or other related functions as would be understood by those of skill in the art.

Low battery conditions can be indicated by the display 20*b*. Additionally, the unit 20 can be automatically inactivated after a predetermined time interval, such as 30 minutes, to promote a longer battery life.

It will be understood that alternate embodiments of the unit 20, responsive to, for example, visible light, come within the spirit and scope of the present invention. Similarly, alternate analog protocols, which might be used with visible light, also come within the spirit and scope of the present invention.

Figure 8:
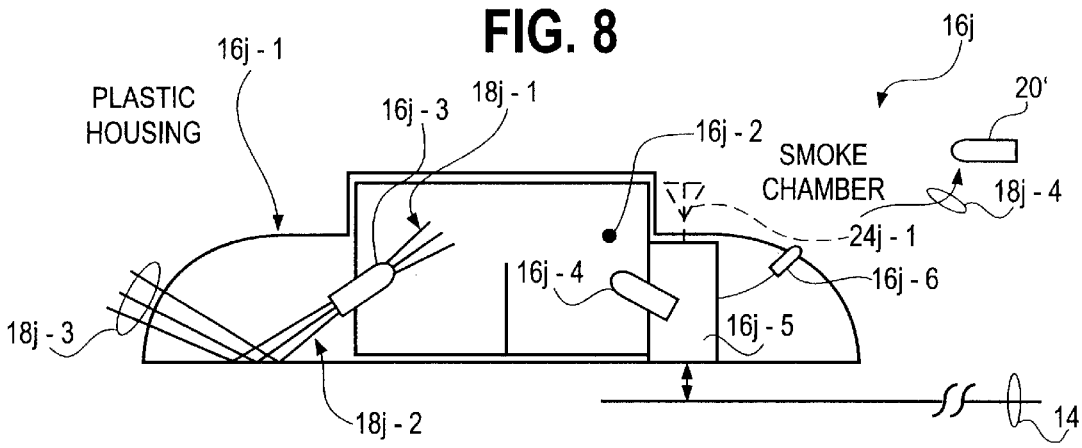
FIG. 8 is an alternate embodiment of a detector in accordance with the present invention.

FIG. 8 illustrates a detector 16*j*, an alternate embodiment to the detector 16*i*. The detector 16*j* includes a plastic housing 16*j*-1 which carries a smoke chamber 16*j*-2. The chamber 16*j*-2 could be implemented as a photoelectric smoke chamber or as an ionization-type smoke chamber.

It will also be understood that the unit 16*j* could carry other types of ambient condition sensors without departing from the spirit and scope of the present invention. These include thermo sensors, gas sensors, position sensors, intrusion sensors, velocity sensors and the like, all without limitation.

Where the smoke chamber 16*j*-2 is implemented as a photoelectric smoke chamber, it incorporates an emitter 16*j*-3 which could be implemented as an infrared laser diode or light emitting diode. A sensor of scattered radiant energy 16*j*-4 is carried in chamber 16*j*-2 and is coupled to control circuitry 16*j*-5.

The unit 16*j* can be in wireless communication with input/output interface circuitry in control circuits 16*j*-5 which are in turn coupled to bi-directional wired medium 14. Alternately, at the unit 16*j* can incorporate a wireless antenna, such as the exemplary wireless antenna 24*i*-1 corresponding to wireless communication exhibited by the members of the plurality 24.

The electrical unit 16*j* also carries a light emitting diode 16*j*-6 which is carried by housing 16*j*-1 such that the diode 16*j*-6 directly emits radiant energy, such as radiant energy 18*j*-4 into the region in which the unit 16*j* is located. The emitted radiant energy 18*j*-4 which could be emitted as visible light or if desired, as infrared can in turn be sensed by hand-held reader 20'. Other alternates include RF or sonic transmission.

The reader 20' is configured as is the reader 20 for the type of radiant energy, visible or infrared that it is intended to sense. The reader 20' includes processing circuitry 20*f'* which acquires and demodulates data, such as parameter values, general conditions or status information from electrical units such as the unit 16*j*.

Figure 9A:
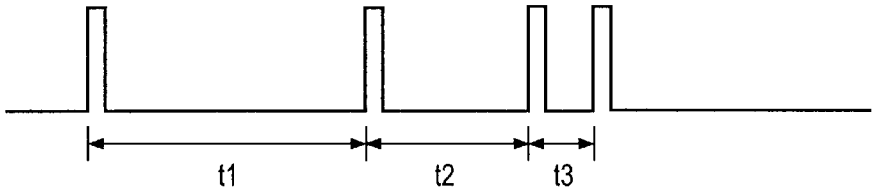
FIGS. 9A–9D are timing diagrams which illustrate alternate analog modulation processes in accordance with the present invention.

FIGS. 9A–9D illustrate alternate forms of analog modulation processable by processing circuitry 20*f'*, using methodologies which are variations of the processing methodology of Fig. A as would be understood by those of skill in the art. FIG. 9A illustrates a protocol which incorporates pulse position modulation. A start pulse is followed by three positioned defined data intervals. Pulse width in this protocol may not be important. Using the analog modulation scheme of FIG. 9A, three pieces of data can be transferred from the respective electrical unit in an analog format. It will be understood that less than or more than three pieces of information can be transferred without departing from the spirit and scope of the present invention.

Figure 9B:
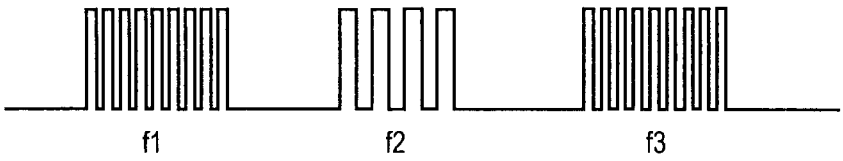

FIG. 9B illustrates frequency modulation wherein pluralities of pulses are frequency modulated, to indicate various values of parameters or status. With this protocol, neither the pulse width nor the pulse amplitude are necessarily critical.

Figure 9C:
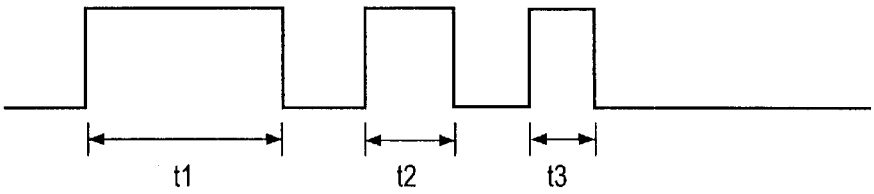

FIG. 9C illustrates transfer of three parameter values or status indicators using pulse width modulation. The widths of the respective pulses are modulated by the information being transferred. With this modulation, pulse amplitude may not be critical.

Figure 9D:
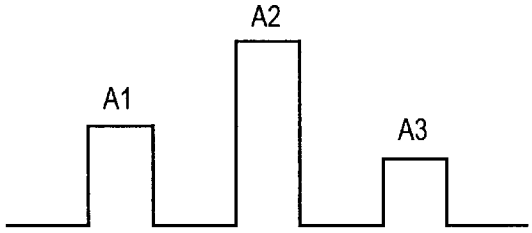

FIG. 9D illustrates transfer of information from an electrical unit to the reader 20' using pulse amplitude modulation. In this protocol, the amplitude of the respective pulses is modulated in accordance with the information to be transmitted. Pulse width may not be critical in this modulation scheme.

It will be understood that one or more of the protocols of FIGS. 9A through 9D can be combined and used to transfer additional information in a single transmission. For example, pulse width and pulse amplitude-type modulation can be combined in a common transmission. Similarly, pulse position modulation could be combined with pulse amplitude modulation to improve transmission efficiency.

It will also be understood that the reader 20' could be used to decode parameter values or status information from electrical units which incorporate a wide variety of ambient condition sensors. In addition, parameter values or status information can be read from other types of electrical units such as output devices which control audible or visible output devices, lock or unlock doors, or the like all without limitation.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

What is claimed:

1. An electrical unit comprising:

a housing which defines an internal region;

a source of radiant energy carried entirely within the housing wherein the source, in response to at least a first selected drive signal, emits radiant energy required to carry out at least a first function within the internal region of the housing, and, the source, in response to at least a second selected drive signal, emits radiant energy required to carry out at least a second function external of the housing that is different than the first function, wherein the radiant energy is detectable within the internal region and external of the housing; and control circuitry, carried within the housing, for coupling the selected drive signals to the source.

2. A unit as in claim 1 wherein the housing includes an internal, ambient condition sensing chamber with the source contained therein.

3. A unit as in claim 2 wherein the source is oriented to direct a beam of radiant energy across at least part of the sensing chamber in carrying out the intra-housing function.

4. A unit as in claim 3 wherein the sensing chamber comprises a smoke sensor, and, wherein the different function comprises information transfer outside of the housing.

5. A unit as in claim 1 wherein the source is contained entirely within the housing and is not visible to a human observer from outside of the housing.

6. An electrical unit comprising:

a housing which defines an internal region;

a source of radiant energy carried entirely within the housing wherein the source, in response to selected drive signals, emits radiant energy required to carry out an intra-housing function;

control circuitry, carried within the housing, for coupling the selected drive signals to the source, and, for providing a different function, detectable outside of the housing by coupling a modulated drive signal to the source; and wherein the housing comprises plastic at least partly transmissive of a selected frequency range wherein the source emits radiant energy in that range.

7. A unit as in claim 4 wherein the drive signals comprise modulation signals for producing modulated, information carrying radiant energy detectable outside of the housing.

8. A unit as in claim 1 wherein the source emits infrared-type radiant energy.

9. A unit as in claim 7 wherein the source emits infrared-type radiant energy.

10. A unit as in claim 1 wherein the emitted radiant energy lies in a range of 820–950 nanometers.

11. A unit as in claim 9 wherein the control circuitry modulates the beam in accordance with selected unit parameters.

12. A detector comprising:

a sensor carried by a housing;

a source of radiant energy carried by the housing wherein the radiant energy is sensed by the sensor within the housing;

a control circuit coupled to the source wherein the control circuitry energizes the source using an analog modulation process to transmit selected information and wherein the selected information is carried by the radiant energy from the source and is detectable externally of the housing.

13. A detector as in claim 12 wherein the source of radiant energy is carried within the housing in a sensing chamber.

14. A detector as in claim 12 wherein the source of radiant energy is carried at an exterior periphery of the housing.

15. A detector as in claim 12 wherein the modulation process comprises at least one of amplitude modulation, pulse position modulation, pulse width modulation and frequency modulation.

16. A monitoring system comprising:

a communication medium;

a plurality of spaced apart ambient condition detectors coupled to the medium wherein at least one member of the plurality includes a common radiant energy source for a sensing function and for a non-sensing function in the respective ambient condition detector.

17. A system as in claim 16 wherein at least some of the detectors each include an opaque housing transmissive of at least some of the radiant energy and wherein the communication medium is wired with the different medium being wireless.

18. A system as in claim 16 wherein at least some of the sources comprise infrared emitters.

19. A system as in claim 16 which includes circuitry for wirelessly transmitting the information in a selected analog format.

20. A system as in claim 19 wherein the circuitry varies a pulse spacing parameter to transmit the information in an analog format.

21. A system as in claim 19 wherein the circuitry generates at least two spaced apart information related pulses.

22. A system as in claim 21 wherein the circuitry generates a sensing related pulse in combination with the at least two pulses.

23. A system as in claim 22 wherein the sensing related pulse precedes the at least two pulses.

24. A system as in claim 19 which includes a portable receiving unit with a sensor responsive to received wireless signals from a selected detector; and unit circuitry coupled to the sensor for demodulating the received signals.

25. A system as in claim 24 wherein the unit circuitry includes circuitry to convert the demodulated signals to displayable indicia indicative of information transmitted from the selected detector.

26. A detector comprising:

a housing which defines an internal region;

a source of radiant energy carried entirely within the housing for emitting a beam of radiant energy into a sensing region within the housing, and simultaneously transmitting a portion of the beam through part of the housing; and control circuits coupled to the source for first modulating the beam to carry out an intra-housing sensing function and second modulating the beam to carry out a radiant, extra-housing, information transmission function.

27. A detector as in claim 26 wherein the second modulating comprises imposing one of amplitude modulation, pulse position modulation, pulse width modulation, or, frequency modulation on the radiant energy beam.

28. A detector as in claim 26 which includes a radiant energy sensor in the sensing region, responsive to the source, for emitting a signal indicative of a pre-selected ambient condition.

* * * * *